US006619777B2

(12) United States Patent
Chang

(10) Patent No.: US 6,619,777 B2
(45) Date of Patent: Sep. 16, 2003

(54) LIQUID JET APPARATUS AND METHOD FOR DRIVING THE SAME

(75) Inventor: Junhua Chang, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/948,102

(22) Filed: Sep. 7, 2001

(65) Prior Publication Data

US 2002/0033852 A1 Mar. 21, 2002

(30) Foreign Application Priority Data

Sep. 8, 2000 (JP) ..... 2000-273749
Aug. 29, 2001 (JP) ..... 2001-259216

(51) Int. Cl.[7] ..... B41J 29/38
(52) U.S. Cl. ..... 347/10; 347/9; 347/11; 347/68
(58) Field of Search ..... 347/10, 11, 9, 347/94, 68, 69, 70

(56) References Cited

FOREIGN PATENT DOCUMENTS

| | | | |
|---|---|---|---|
| EP | 0963845 | 12/1999 | |
| EP | 0 963 845 | 12/1999 | ..... B41J/2/045 |
| EP | 1023999 | 8/2000 | |
| EP | 1 093 917 | 4/2001 | ..... B41J/2/045 |

*Primary Examiner*—Judy Nguyen
*Assistant Examiner*—Lam S Nguyen
(74) *Attorney, Agent, or Firm*—Sughrue Mion, PLLC

(57) ABSTRACT

A driving signal generation unit generates a plurality of kinds of driving pulses and a minute vibration pulse to be applied to a pressure generation element so as to finely vibrate a meniscus of liquid. A pulse generation unit generates the minute vibration pulse and the driving pulses by selecting a part of the driving signal. The driving signal includes a plurality of waveform elements used to generate the driving pulses and a connection element used to connect the waveform elements between different voltage levels and not used to generate the driving pulses. The pulse generation unit generates the minute vibration pulse by a combination of at least a part of the waveform elements and at least a part of the connection element. A plurality of driving pulses for ejecting a plurality of kinds of ink drops and a minute vibration pulse for causing minute vibrations to a meniscus of liquid can be efficiently put in a driving signal of one driving period.

24 Claims, 7 Drawing Sheets

LIQUID JET APPARATUS AND METHOD FOR DRIVING THE SAME

BACKGROUND OF THE INVENTION

1. Field of the Invention

The present invention relates to a liquid jet apparatus for ejecting liquid drops of a plurality of kinks different in volume from the same nozzle opening and a method for driving the same.

2. Description of the Related Art

An ink jet recorder which is an example of a liquid jet apparatus has a recording head having many nozzle openings formed in a row, a carriage mechanism for moving the recording head in the main scanning direction (the width direction of recording paper), and a paper feed mechanism for moving a recording paper in the sub-scanning direction (the paper feeding direction).

The recording head has a plurality of pressure chambers each interconnected to each of the nozzle openings and a plurality of pressure generation elements each for changing the ink pressure in each of the pressure chambers. In the recording head, a driving pulse is fed to the pressure generation element, thereby the ink pressure in the pressure chamber is changed, and then, an ink drop is ejected from the nozzle opening.

The carriage mechanism moves the recording head in the main scanning direction. During this movement, the recording head ejects ink drops in the timing specified dot pattern data. When the recording head reaches the terminal of the movement range, the paper feed mechanism moves the recording paper in the sub-scanning direction. When the movement of the recording paper is finished, the carriage mechanism moves the recording head in the main scanning direction again and the recording head ejects ink drops during movement.

By performing the aforementioned operation repeatedly, an image on the basis of the dot pattern data is recorded on the recording paper.

The recorder records an image depending on whether or not to eject ink drops, that is, existence of dots. Therefore, in this recorder, a method for representing the intermediate gradation by representing one pixel by a plurality of dots such as 4×4 and 8×8 is adopted. To record a high-quality image by this method, it is necessary to eject ink drops with an extremely small volume from the recording head.

With the foregoing in view, to satisfy conflicting requests of improvement of the image quality and improvement of the recording speed, an art for ejecting ink drops different in size from the same nozzle is proposed. For example, by supplying a plurality of pulse signals capable of generating minute ink drops, a plurality of minute ink drops are ejected from the same nozzle, and the respective ink drops are joined before reaching on the recording paper, and a large ink drop is generated.

However, in this art, the number of ink drops to be joined before reaching on the recording paper is limited, so that the size of ink drops is limited and the variable range of size is narrowed. Furthermore, since a plurality of ink drops must be joined before reaching on the recording paper, the control is inevitably difficult.

Therefore, an art for generating a driving signal connecting a plurality of kinds of driving pulses in series depending on the volume of ink drops to be ejected and supplying a driving pulse obtained from this driving signal to the pressure generation element can be considered.

However, in the aforementioned art, when a plurality of kinds of driving pulses are connected simply in series, the driving period (the period of the driving signal) necessary to record one dot becomes inevitably longer. Namely, in this art, it is necessary to connect driving pulses in correspondence to the number of the kinds of ink volumes to be ejected and the driving period becomes longer in correspondence to the number of connected driving pulses. And, when the driving period becomes longer, the recording speed becomes slower.

Further, at the nozzle openings of the recording head, the meniscus, that is, the free surface of ink exposed at the nozzle openings is exposed to the air, so that an ink solvent (for example, water) evaporates gradually. When the ink viscosity of ink at the nozzle openings rises due to evaporation of the ink solvent, a fault such as a splash of ejected ink drops in a direction shifted from the normal direction may be caused.

Therefore, in the ink jet recorder, ink is stirred by minute vibration of the meniscus and an increase in ink viscosity at the nozzle openings is prevented. At the time of stirring by the minute vibration, a minute vibration pulse is applied to the pressure generation element so as to cause a pressure change in the pressure chamber and the meniscus is slightly moved or vibrated in the ejection and pull-in directions.

However, when driving pulses for ejecting ink drops from the nozzle openings and a minute vibration pulse for generating minute vibration in the meniscus are simply connected in series so as to form the aforementioned driving signal, the time of one driving period becomes longer and the printing speed is reduced.

The present invention was developed with the foregoing in view and is intended to efficiently put a plurality of driving pulses for ejecting a plurality of kinds of ink drops different in ink volume and a minute vibration pulse for causing minute vibration to the meniscus in a driving signal of one driving period.

SUMMARY OF THE INVENTION

To solve the aforementioned problems, a liquid jet apparatus according to the present invention comprises: a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening; driving signal generation unit to generate a driving signal to be used for generating a plurality of kinds of said driving pulses for ejecting said liquid drop and a minute vibration pulse to be applied to said pressure generation element so as to finely vibrate a meniscus of said liquid; and pulse generation unit to generate said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, and wherein said pulse generation means generates said minute vibration pulse by a combination of at least a part of said waveform elements and at least a part of said connection element.

Preferably, said driving pulses eject a plurality of kinds of said liquid drops different in volume, said driving pulse for ejecting said liquid drop of a smallest volume being generated by a combination of a plurality of said waveform elements, and said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element.

Preferably, a part of said waveform elements for ejecting said liquid drop of a smallest volume is formed in a step shape, said connection element for connecting said part of a plurality of said waveform elements for ejecting said liquid drop of a smallest volume to another said waveform element is formed in a step shape, and said minute vibration pulse is generated by a combination of a half of said waveform element of a step shape and a half of said connection element of a step shape.

Preferably, said connection element follows said part of a plurality of said waveform elements for ejecting said liquid drop of a smallest volume, and said connection element expands or contracts said pressure chamber in the same direction as said part of a plurality of said waveform elements for ejecting said liquid drop of a smallest volume does and then contracts or expands said pressure chamber in the opposite direction.

Preferably, said part of a plurality of said waveform elements used for generating said minute vibration pulse is a preparatory waveform element which contracts said pressure chamber of waiting condition without ejecting said liquid drop.

Preferably, a single pulse of said minute vibration pulse is generated in a single period of said driving signal.

Preferably, said minute vibration pulse is generated from said at least a part of said waveform elements and said at least a part of said connection element following said at least a part of said waveform elements.

Preferably, said plurality of waveform elements include ejection waveform elements for operating said pressure generation element so as to eject said liquid drops from said nozzle opening and charging waveform elements for operating said pressure generation element so as to charge said pressure chamber with said liquid, and said pulse generation means generates said plurality of kinds of said driving pulses depending on timing for selecting said ejection waveform elements and said charging waveform elements.

Preferably, said plurality of kinds of said driving pulses eject a plurality of kinds of said liquid drops different in volume, and said plurality of waveform elements include a pair of said ejection waveform elements for ejecting said liquid drop of a largest volume and said ejection waveform element, disposed between said pair of said ejection waveform elements, for ejecting said liquid drop of a smallest volume.

Preferably, said pressure generation element comprises a piezo-electric vibrator of a deflection vibration mode.

Preferably, said pressure generation element comprises a piezo-electric vibrator of a longitudinal vibration mode.

To solve the aforementioned problems, a method according to the present invention for driving a liquid jet apparatus with a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening, comprises the steps of: generating a driving signal to be used for generating a plurality of kinds of said driving pulses for ejecting said liquid drop and a minute vibration pulse to be applied to said pressure generation element so as to finely vibrate a meniscus of said liquid; and generating one of said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, and wherein said minute vibration pulse is generated by a combination of at least a part of said waveform elements and at least a part of said connection element.

Preferably, said driving pulses eject a plurality of kinds of said liquid drops different in volume, said driving pulse for ejecting said liquid drop of a smallest volume being generated by a combination of a plurality of said waveform elements, and said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element.

Preferably, a part of said waveform elements for ejecting said liquid drop of a smallest volume is formed in a step shape, said connection element for connecting said part of a plurality of said waveform elements for ejecting said liquid drop of a smallest volume to another said waveform element is formed in a step shape, and said minute vibration pulse is generated by a combination of a half of said waveform element of a step shape and a half of said connection element of a step shape.

Preferably, said connection element follows said part of a plurality of said waveform elements for ejecting said liquid drop of a smallest volume, and said connection element expands or contracts said pressure chamber in the same direction as said part of a plurality of waveform elements for ejecting said liquid drop of a smallest volume does and then contracts or expands said pressure chamber in the opposite direction.

Preferably, said part of a plurality of said waveform elements used for generating said minute vibration pulse is a preparatory waveform element which contracts said pressure chamber of waiting condition without ejecting said liquid drop.

Preferably, a single pulse of said minute vibration pulse is generated in a single period of said driving signal.

Preferably, said minute vibration pulse is generated from said at least a part of said waveform elements and said at least a part of said connection element following said at least a part of said waveform elements.

Preferably, said plurality of waveform elements include ejection waveform elements for operating said pressure generation element so as to eject said liquid drops from said nozzle opening and charging waveform elements for operating said pressure generation element so as to charge said pressure chamber with said liquid, and said pulse generation means generates said plurality of kinds of said driving pulses depending on timing for selecting said ejection waveform element and said charging waveform element.

Preferably, said plurality of kinds of said driving pulses eject a plurality of kinds of said liquid drops different in volume, and said plurality of waveform elements include a pair of said ejection waveform elements for ejecting said liquid drop in a largest volume and said ejection waveform element, disposed between said pair of said ejection waveform elements, for ejecting said liquid drop of a smallest volume.

Preferably, said pressure generation element comprises a piezo-electric vibrator of a deflection vibration mode.

Preferably, said pressure generation element comprises a piezo-electric vibrator of a longitudinal vibration mode.

BRIEF DESCRIPTION OF THE DRAWINGS

The present invention will be understood more fully from the detailed description given hereunder and from the accompanying drawings of the preferred embodiments of the invention. However, the drawings are not intended to imply limitations of the invention to a specific embodiment, but are for explanations and understandings only.

In the drawings.

DETAILED DESCRIPTION OF THE PREFERRED EMBODIMENTS

An embodiment of the present invention will be explained hereunder with reference to the accompanying drawings.

Figure 1:
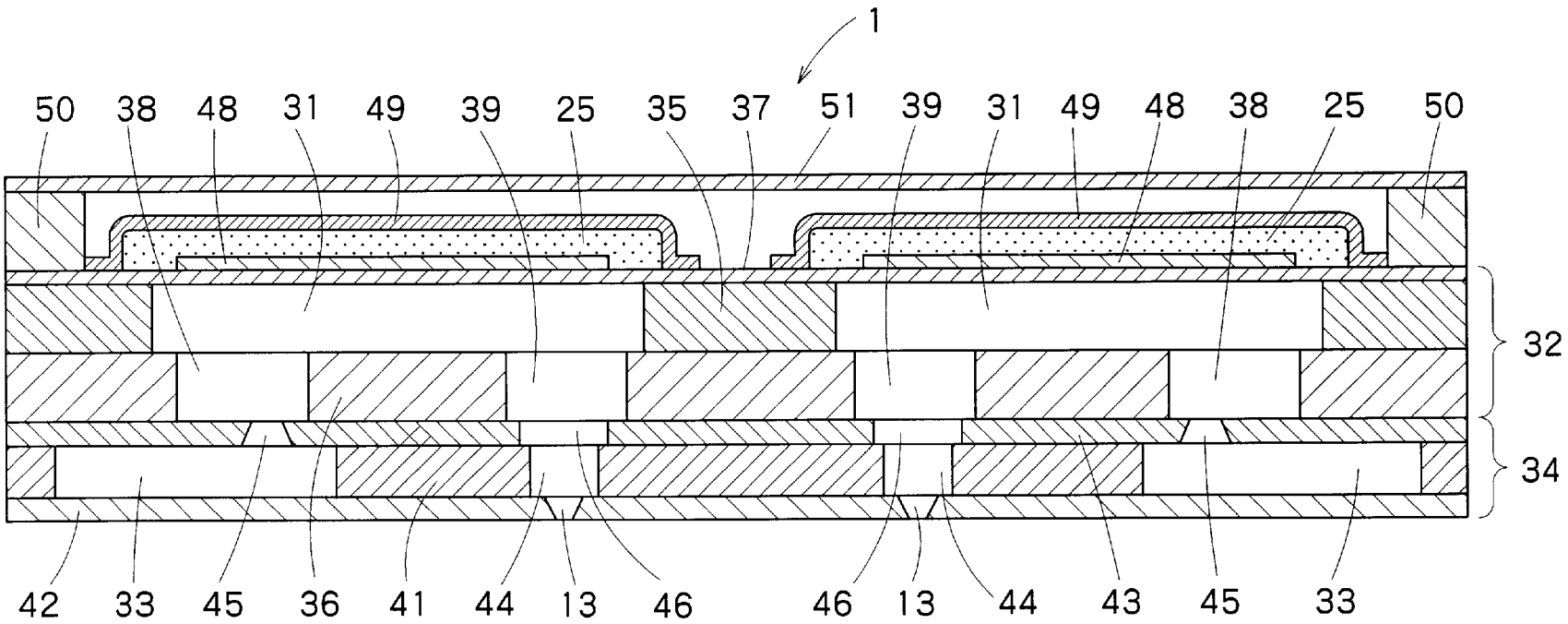
FIG. 1 is a sectional view showing the structure of a recording head of an ink jet recorder as an embodiment of a liquid jet apparatus according to the present invention.

FIG. 1 shows the structure of a recording head of an ink jet recorder as an embodiment of a liquid jet apparatus of the present invention. A recording head shown in FIG. 1 is a recording head 1 having piezo-electric vibrators 25 of a deflection vibration mode.

The recording head 1 has an actuator unit 32 in which a plurality of pressure chambers 31 are formed, a flow path unit 34 in which nozzle openings 13 and common ink chambers 33 are formed, and the piezo-electric vibrators 25. On the front of the actuator unit 32, the flow path unit 34 is joined and on the back of the actuator unit 32, the piezo-electric vibrators 25 are arranged.

The pressure chambers 31 are expanded and contracted in correspondence to deformations of the piezo-electric vibrators 25 to change the ink pressure in the pressure chambers 31. Ink drops (liquid drops) are ejected from the nozzle openings 13 due to changes in the ink pressure in the pressure chambers 31. For example, when the pressure chamber 31 is contracted suddenly, the pressure chamber 31 is internally pressurized and an ink drop is ejected from the nozzle opening 13.

The actuator unit 32 is composed of a pressure chamber forming substrate 35 in which air spaces for forming the pressure chambers 31 are formed, a cover member 36 joined on the front of the pressure chamber forming substrate 35, and a diaphragm 37 joined on the back of the pressure chamber forming substrate 35 so as to block the opening surfaces of the air spaces. In the cover member 36, first ink flow paths 38 for interconnecting the common ink chambers 33 and the pressure chambers 31 and second ink flow paths 39 for interconnecting the pressure chambers 31 and the nozzle openings 13 are formed.

The flow path unit 34 is composed of an ink chamber forming substrate 41 in which air spaces for forming the common ink chambers 33 are formed, a nozzle plate 42 joined on the front of the ink chamber forming substrate 41, and a feed port forming plate 43 joined on the back of the ink chamber forming substrate 41.

In the ink chamber forming substrate 41, nozzle interconnection ports 44 interconnecting to the nozzle openings 13 are formed. In the feed port forming plate 43, ink feed ports 45 for interconnecting the common ink chambers 33 and the first ink flow paths 38 and interconnection ports 46 for interconnecting the nozzle interconnection ports 44 and the second ink flow paths 39 are bored.

Therefore, in the recording head 1, a series of ink flow paths are formed between the common ink chambers 33 and the nozzle openings 13 via the pressure chambers 31.

The piezo-electric vibrators 25 are formed on the opposite side of the pressure chambers 31 with respect to the diaphragm 37. The piezo-electric vibrators 25 are in a flat-plate shape, and lower electrodes 48 are formed on the front of each of the piezo-electric vibrators 25, and upper electrodes 49 are formed on the back of each of the piezo-electric vibrators 25 so as to cover the piezo-electric vibrators 25.

At both ends of the actuator unit 32, connection terminals 50 of which the end parts are conducted to the upper electrodes 49 of the respective piezo-electric vibrators 25 are formed. The end faces of the connection terminals 50 are formed higher than the piezo-electric vibrators 25. To the end faces of the connection terminals 50, a flexible circuit substrate 51 is joined and a driving waveform is supplied to the piezo-electric vibrators 25 via the connection terminals 50 and the upper electrodes 49.

The numbers of the pressure chambers 31, the piezo-electric vibrators 25, and the connection terminals 50 shown in the drawing are just two respectively, though many units are installed in correspondence with the nozzle openings 13.

In the recording head 1, when a driving pulse is input, a voltage difference occurs between the upper electrode 49 and the lower electrode 48. By this voltage difference, the piezo-electric vibrator 25 is contracted perpendicularly to the electric field. In this case, the part of the piezo-electric vibrator 25 on the side of the lower electrode 48 which is joined to the diaphragm 37 is not contracted and only the part on the side of the upper electrode 49 is contracted, so that the piezo-electric vibrator 25 and the diaphragm 37 is deflected so as to project on the side of the pressure chamber 31 and the volume of the pressure chamber 31 is contracted.

When an ink drop is to be ejected from the nozzle opening 13, for example, the pressure chamber 31 is contracted suddenly. Namely, when the pressure chamber 31 is contracted suddenly, the ink pressure in the pressure chamber 31 increases and an ink drop is ejected from the nozzle opening 13 in correspondence to the pressure rise. Further, when the voltage difference between the upper electrode 49 and the lower electrode 48 is eliminated, the piezo-electric vibrator 25 and the diaphragm 37 are returned to their original conditions. By doing this, the contracted pressure chamber 31 is expanded internally and ink is fed into the pressure chamber 31 from the common ink chamber 33 via the ink feed port 45.

Figure 2:
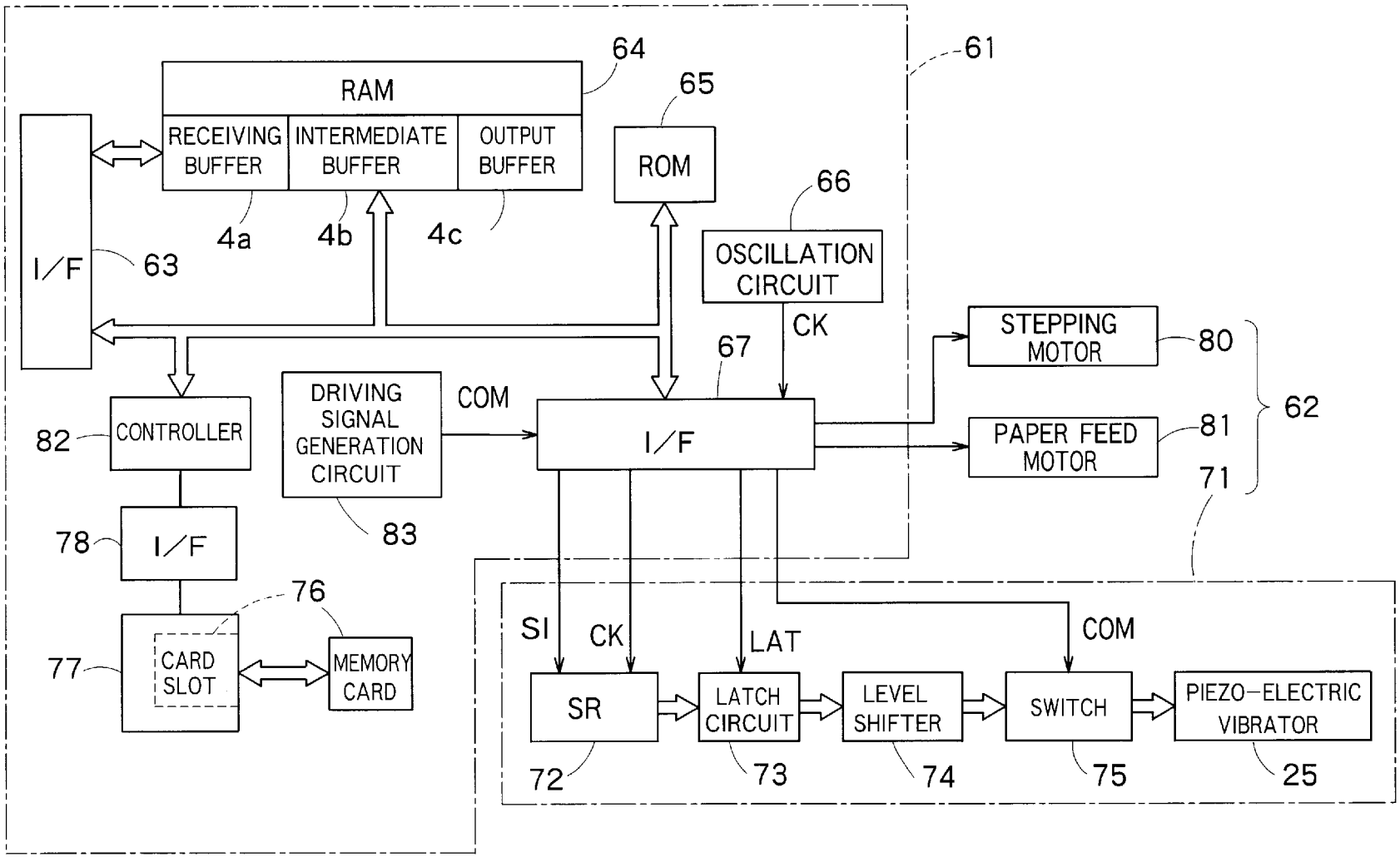
FIG. 2 is a block diagram of the ink jet recorder as the embodiment of the liquid jet apparatus according to the present invention.

FIG. 2 is a block diagram of the ink jet recorder of this embodiment. As shown in FIG. 2, the recorder has a printer controller 61 and a print engine 62. The printer controller 61 has an interface 63 for receiving print data from the host computer (not shown in the drawing), a RAM 64 for storing various data, a ROM 65 for storing control routines for various data processes, a controller 82 composed of a CPU, an oscillation circuit 66, a driving signal generation circuit (driving signal generation means) 83 for generating a driving signal to be supplied to the recording head 1, and an interface 67 for transmitting print data expanded to dot pattern data (bit map data) and a driving signal to the print engine 62.

In addition to this, the printer controller 61 holds a memory card 76 which is a kind of recording medium in a removable state and has a card slot 77 for functioning as a recording medium holding part and a card interface 78 for transmitting information recorded in the memory card 76 to the controller 82. In the memory card 76, data concerning the waveforms of driving signals is recorded. As a recording medium other than the memory card 76, for example, a floppy disk, a hard disk, or a photo-electromagnetic disk may be used.

The controller 82 is a kind of computer and controls ejection of ink drops by referring to the waveform data of driving signals recorded in the memory card 76 and the control routine recorded in the ROM 65.

The interface 63 receives print data composed of, for example, any one data of a character code, a graphic function, and image data or a plurality of data from the host computer. Further, the interface 63 can output a busy (BUSY) signal or an acknowledge (ACK) signal to the host computer.

The RAM 64 may be used as a receiving buffer, an intermediate buffer, an output buffer, or a work memory (not shown in the drawing). In the receiving buffer, print data from the host computer is stored temporarily, and in the intermediate buffer, intermediate code data is stored, and in the output buffer, dot pattern data is expanded.

The ROM 65 stores various control routines executed by the controller 82, font data, and graphic functions.

In the ROM 65, the control routine (control program) continuously used without being changed is stored. Data concerning the waveforms of driving signals which are expected to be upgraded or changed are stored in the memory card 76.

The controller 82 controls the driving signal generation circuit 83 on the basis of the data concerning the waveforms of driving signals read from the memory card 76 and generates a predetermined driving signal which will be described later in detail.

The print engine 62 is composed of a stepping motor 80, a paper feed motor 81, and an electric driving system 71 for the recording head 1. The electric driving system 71 for the recording head 1 has a shift register 72, a latch circuit 73, a level shifter 74, a switch 75, and piezo-electric vibrators 25. The shift register 72, the latch circuit 73, the level shifter 74, and the switch 75 function as pulse generation means of the present invention.

Figure 3:
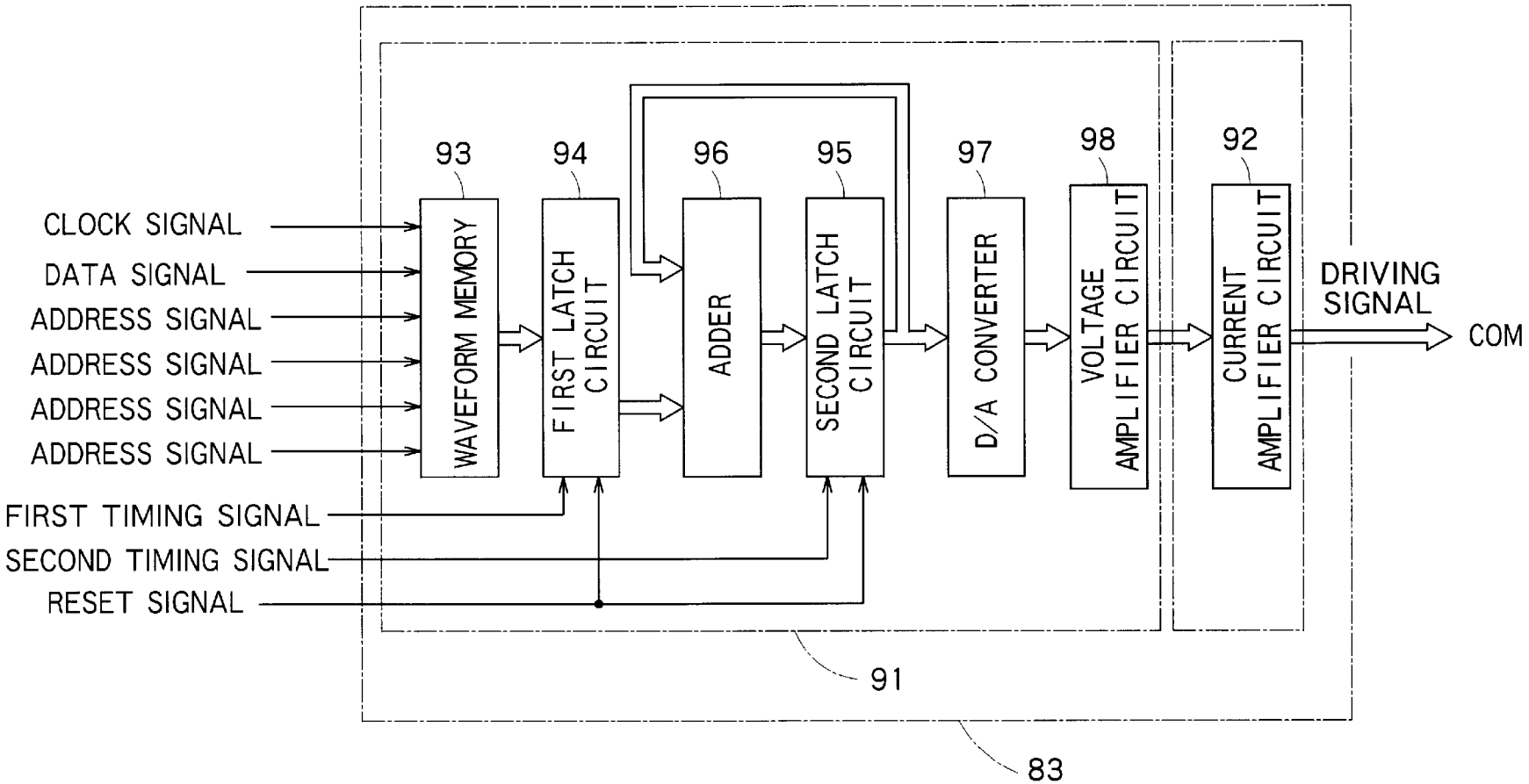
FIG. 3 is a block diagram showing the essential section of a driving signal generation circuit of the ink jet recorder as the embodiment of the liquid jet apparatus according to the present invention.

FIG. 3 shows an example of the driving signal generation circuit 83 including a waveform generation circuit 91 and a current amplifier circuit 92.

The waveform generation circuit 91 has a waveform memory 93, a first waveform latch circuit 94, a second waveform latch circuit 95, an adder 96, a digital-analog converter 97, and a voltage amplifier circuit 98.

The waveform memory 93 functions as a variation data storage unit to individually store a plurality of kinds of voltage variation data output from the controller 82. The first waveform latch circuit 94 is electrically connected to the waveform memory 93. The first waveform latch circuit 94 holds voltage variation data stored at a predetermined address of the waveform memory 93 in synchronization with a first timing signal. To the adder 96, output of the first waveform latch circuit 94 and output of the second waveform latch circuit 95 are input, and to the output side of the adder 96, the second waveform latch circuit 95 is electrically connected. The adder 96 functions as a variation data adding means and adds and outputs output signals.

The second waveform latch circuit 95 is an output data holding unit to hold data (voltage information) output from the adder 96 in synchronization with a second timing signal. The D-A converter 97 is electrically connected to the output side of the second waveform latch circuit 95 and converts an output signal held by the second waveform latch circuit 95 to an analog signal. The voltage amplifier circuit 98 is electrically connected to the output side of the D-A converter 97 and amplifies the analog signal converted by the D-A converter 97 up to the voltage of a driving signal.

The current amplifier circuit 92 is electrically connected to the output side of the voltage amplifier circuit 98 and amplifies the current of a signal amplified in voltage by the voltage amplifier circuit 98 and outputs it as a driving signal (COM).

In the driving signal generation circuit 83 having the aforementioned constitution, prior to generation of a driving signal, a plurality of variation data indicating voltage variations are individually stored in the storage area of the waveform memory 93. For example, the controller 82 outputs variation data and address data corresponding to this variation data to the waveform memory 93. And, the waveform memory 93 stores the variation data in the storage area designated by the address data. The variation data is composed of data including positive and negative information (increase and decrease information) and the address data is composed of a 4-bit address signal.

When a plurality of kinds of variation data is stored in the waveform memory 93 in this way, a driving signal can be generated.

A driving signal is generated by setting variation data in the first waveform latch circuit 94 and adding the variation data set in the first waveform latch circuit 94 to the output voltage from the second waveform latch circuit 95 every predetermined update period.

As a computer other than the controller 82, for example, a host computer directly connected to the recorder independently or one among many computers connected via a network may be cited.

In the recording head 1 shown in FIG. 1, it can be controlled whether or not to input a driving signal to the piezo-electric vibrators 25 by print data. For example, during a period of print data of "1", the switch 75 is in a connection state, so that the driving signal (COM) is supplied to the piezo-electric vibrators 25. The piezo-electric vibrators 25 are deformed by the supplied driving signal. Further, during a period of print data of "0", the switch 75 is in a non-connection state, so that the supply of the driving signal to the piezo-electric vibrators 25 is interrupted. During the period of print data of "0", each of the piezo-electric vibrators 25 holds the preceding charge and the preceding deformation condition is maintained.

Next, the driving method for the ink jet recorder in this embodiment will be explained. The ink jet recorder in this embodiment ejects large ink drops for forming large dots, medium ink drops for forming medium dots, and small ink drops for forming small dots from the same nozzle opening 13. Here, "large dots" typically means comparatively large dots formed from large ink drops of about 20 pL (picoliter) in volume. "Medium dots" typically means medium dots formed from medium ink drops of about 8 pL in volume. "Small dots" typically means comparatively small dots formed from small ink drops of about 4 pL in volume.

In this embodiment, two large dot ejection waveform elements constituting a large dot driving pulse are formed in the same shape and the large dot ejection waveform elements are arranged every constant period in the driving signal. Furthermore, a small dot ejection waveform element is arranged between the large dot ejection waveform elements in the driving signal.

Figure 4:
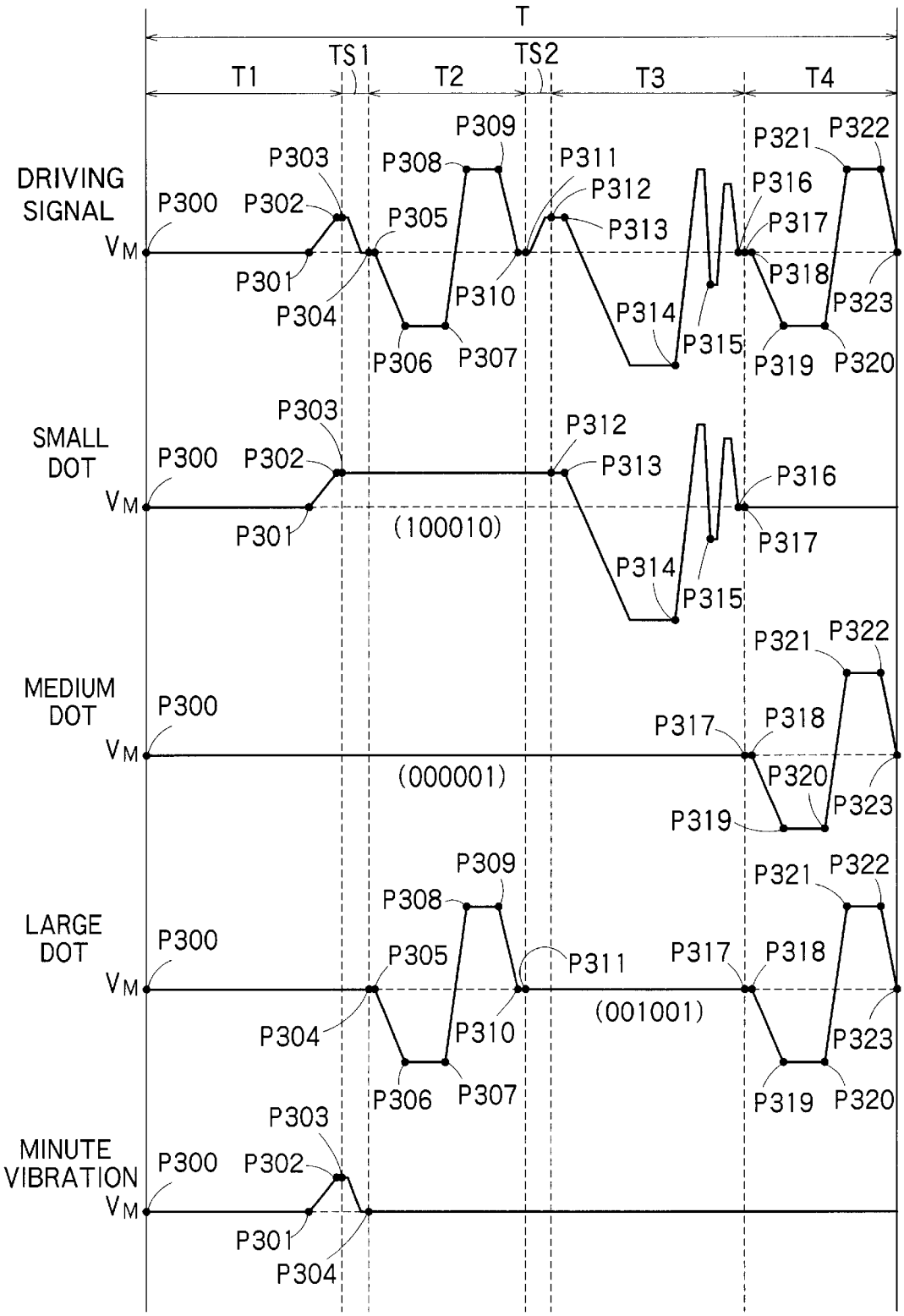
FIG. 4 is a drawing showing a driving signal, various driving pulses, and a minute vibration pulse of the embodiment according to the present invention.

FIG. 4 is a drawing showing the waveform of a driving signal generated by the driving signal generation circuit 83 together with driving pulses for large, medium, and small dots and a minute vibration pulse generated from this driving signal. In this case, "minute vibration" pulse is a pulse to be applied to the piezo-electric vibrators 25 for finely vibrating the meniscus of ink (liquid) at the nozzle opening 13 of the recording head 1 without ejecting an ink drop. On the other hand, pulses to be applied to the piezo-electric vibrators 25 so as to eject large, medium, and small dots are called driving pulses.

In the driving signal shown in FIG. 4, the part of the period T1 (P300 to P303) is the first waveform element and the part of the period T2 (P304 to P311) is the second waveform element. The part of the period T3 (P312 to P317) is the third waveform element and the part of the period T4 (P317 to P323) is the fourth waveform element. The part of the period TS1 (P303 to P304) is the first connection element and the part of the period TS2 (P311 to P312) is the second connection element.

In this case, "connection element" is a signal element for connecting a plurality of waveform elements between different voltage levels and is not used to generate a driving pulse for ejecting an ink drop. On the other hand, "waveform element" is a signal element used to generate a driving pulse for ejecting an ink drop. As described hereunder, at least a part of the connection element is used to generate a minute vibration pulse.

The aforementioned first waveform element includes a contraction waveform element (P301 to P302). This contraction waveform element is a preparatory waveform element which contracts the pressure chamber 31 of waiting condition without ejecting an ink drop. The second waveform element includes a first charge waveform element (P305 to P307), a first ejection waveform element (P307 to P309), and a first vibration damping waveform element (P309 to P310). The third waveform element includes a second charge waveform element (P313 to P314), a second ejection waveform element (P314 to P315), and a second vibration damping waveform element (P315 to P316). The fourth waveform element includes a third charge waveform element (P318 to P320), a third ejection waveform element (P320 to P322), and a third vibration damping waveform element (P322 to P323). The end point (P323) of the third vibration damping waveform element is the start point (P300) of the first waveform element in the next driving period T.

In this case, the "contraction waveform element" is a signal element for operating the piezo-electric vibrators 25 so as to reduce the volume of the pressure chambers 31. The "ejection waveform element" is a signal element for operating the piezo-electric vibrators 25 so as to eject ink drops from the nozzle openings 13. The "vibration damping waveform element" is a signal element for operating the piezo-electric vibrators 25 so as to suppress the vibration of the meniscus after ejection of ink drops.

To generate a small dot driving pulse from the aforementioned driving signal, the pulse generation means (that is, the shift register 72, the latch circuit 73, the level shifter 74, and the switch 75) selects the first waveform element and the third waveform element and connects the selected waveform elements. Concretely, the pulse generation means selects waveform elements on the basis of the print data set in "100010".

Further, when a medium dot driving pulse is to be generated, the pulse generation means selects the fourth waveform element on the basis of the print data set in "000001". Namely, the fourth waveform element constitutes a medium dot driving pulse independently.

Furthermore, when a large dot driving pulse is to be generated, the pulse generation means selects the second waveform element and the fourth waveform element on the basis of the print data set in "001001" and connects them. In the large dot driving pulse, the first ejection waveform element (P307 to P309) of the second waveform element and the third ejection waveform element (P320 to P322) of the fourth waveform element are large dot ejection waveform elements.

With respect to the two large dot ejection waveform elements constituting this large dot driving pulse, the former large dot ejection waveform element (P305 to P310) and the latter large dot ejection waveform element (P318 to P323) are the same in the waveform shape. Further, the time from the start point (P300) of the driving period T to the start point (P305) of the former large dot ejection waveform element and the time from the end point (P310) of the former large dot ejection waveform element to the start point (P318) of the latter large dot ejection waveform element are made equal to each other. Namely, the time from the end point of the large dot ejection waveform element to the start point of the next large dot ejection waveform element is set to a fixed time. Furthermore, between the large dot ejection waveform elements, the small dot ejection waveform (P313 to P316) constituting the small dot driving pulse is arranged.

Further, when a minute vibration pulse is to be generated from the driving signal, the pulse generation means selects the first waveform element (P300 to P303) and the first connection element (P303 to P304). Like this, the minute vibration pulse is generated by a combination of a waveform element and a connection element.

As mentioned above, according to the ink jet recorder of this embodiment, a minute vibration pulse is generated by a combination of a waveform element and a connection element, so that a plurality of driving pulses for generating a plurality of kinds of ink drops different in the ink volume and a minute vibration pulse for causing minute vibration to the meniscus can be set efficiently in a driving signal in one driving period free of reduction in the printing speed, that is, without extending the driving period T.

Moreover, in the present embodiment, a minute vibration pulse is generated from the contraction waveform element (P301 to P302) constituting a preparatory part of a small dot driving pulse and the first connection element (P303 to P304) following the contraction waveform element (P301 to P302). Generally, a contraction waveform element constituting a preparatory part of a small dot driving pulse has a relatively high wave height. Therefore, according to the present embodiment, although a single minute vibration pulse is generated in a single driving period, a sufficient ink stirring effect can be obtained.

Furthermore, according to the present embodiment, a minute vibration pulse is generated by selecting the waveform element (P301 to P302) which contracts the pressure chamber 31 and the connection element (P303 to P304) which expands the pressure chamber 31, following the waveform element (P301 to P302). Since the pressure chamber 31 is contracted and then expanded, an ink stirring effect can be enhanced comparing to the case that the pressure chamber 31 is expanded and then contracted.

Further, in the aforementioned driving signal, the large dot ejection waveform elements are arranged before and after the small dot ejection waveform element, so that, in two-way printing like printing in both forth motion and back motion of the recording head 1 (that is, the carriage), large ink drops are positioned on the basis of the ejection position of small inks drop ejected by the small dot driving pulse, so that the ejection positions of small ink drops and large ink drops can be aligned with each other.

Further, the former large dot ejection waveform element and the latter large dot ejection waveform element are formed in the same waveform and the volume of an ink drop ejected by the former large dot ejection waveform element can be made equal to the volume of an ink drop ejected by the latter large dot ejection waveform element.

Furthermore, since a large dot ejection waveform element is generated every fixed period in the driving period T, in a case of two-way printing, the same recording condition can be realized in both forth motion and back motion.

As mentioned above, in this embodiment, particularly in a constitution of two-way printing, an image of good quality can be recorded.

Next, the first modification of the aforementioned embodiment will be explained by referring to FIG. 5.

Figure 5:
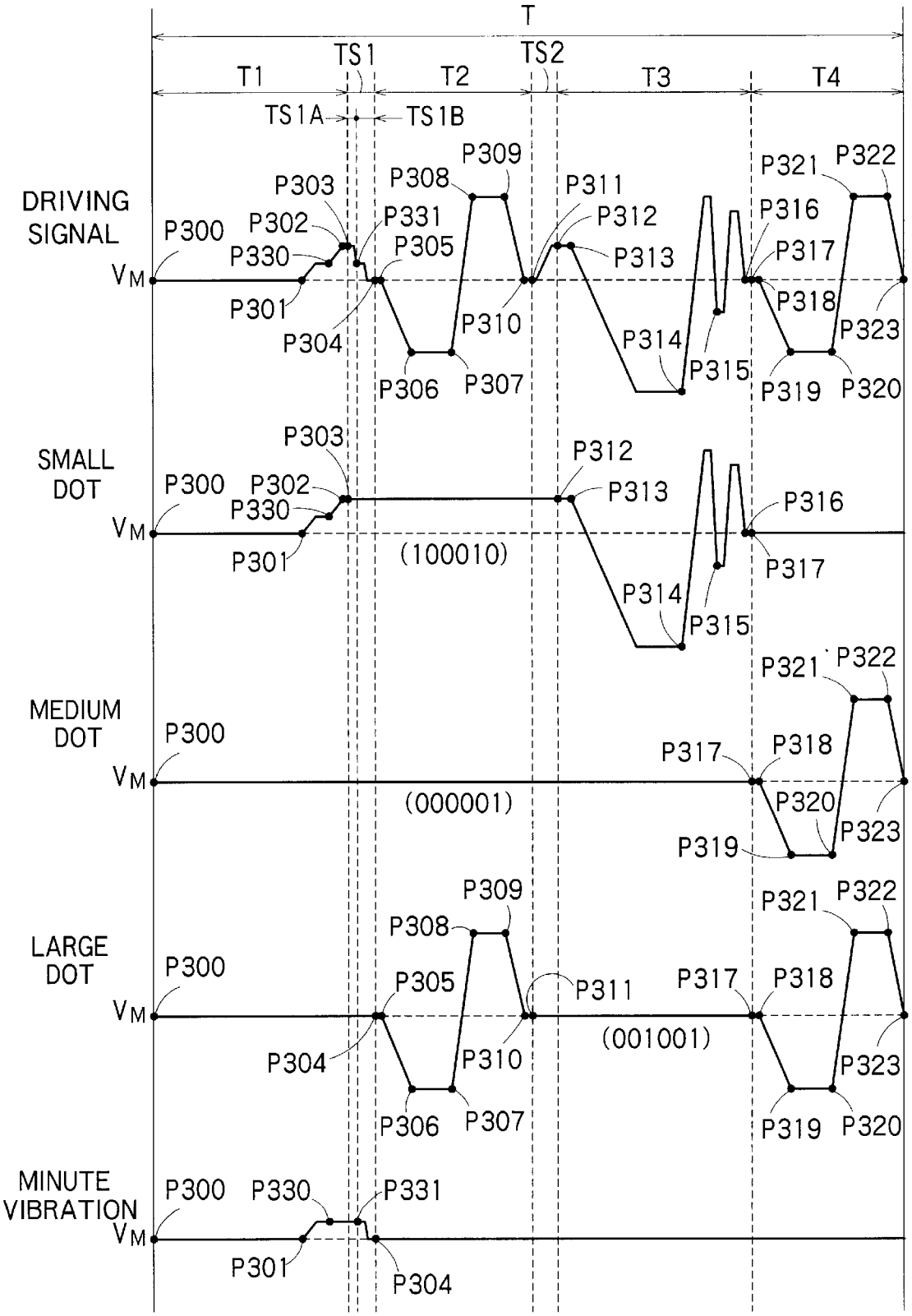
FIG. 5 is a drawing showing a driving signal, various driving pulses, and a minute vibration pulse of a first modification of the embodiment according to the present invention.

FIG. 5 is a drawing showing a driving signal, various driving pulses, and a minute vibration pulse in this modification. Differences between the driving signal shown in FIG. 5 and the driving signal shown in FIG. 4 are that, in the first waveform element of the part (P300 to P303) of the period T1, a step-shaped part (P330 included) is formed between P301 and P302 and also, in the first connection element of the part (P303 to P304) of the period TS1, a step-shaped part (P331 included) is formed. The period TS1 is divided into a period TS1A and a period TS1B at the point of P331.

The step-shaped part (P330 included) in the first waveform element and the step-shaped part (P331 included) in the first connection element are formed at the same voltage level.

When a minute vibration pulse is to be generated from the driving signal, the pulse generation means selects the part of P300 to P301 and the first half (P301 to P330) of the step-shaped part of the first waveform element (P300 to P303) and the latter half (P331 to P304) of the first connection element (P303 to P304) formed in a step shape.

As mentioned above, in this modification, the minute vibration pulse is generated by a combination of at least a part of waveform elements and at least a part of a connection element. Accordingly, some part of a connection element may not be used to generate a minute vibration pulse, as is true with the signal element (P303 to P331) of TS1A.

Moreover, when an ink of high viscosity is used, the pulse generation means selects the whole of the first waveform element (P300 to P303) and the whole of the first connection element (P303 to P304) to generate a minute vibration pulse of relatively high wave height.

As mentioned above, also in this modification, a minute vibration pulse can be generated by a combination of a waveform element and a connection element, so that the same effect as that of the aforementioned embodiment can be obtained.

In addition, according to this modification, since the step-shaped part (P330 included) is formed in the contraction waveform element (P301 to P302) constituting a preparatory part of a small dot driving pulse and the step-shaped part (P331 included) is formed in the first connection element (P303 to P304) following the contraction waveform element (P301 to P302), a wave height of a minute vibration pulse can be set at two level selectively for the sake of these step-shaped parts. Therefore, it is possible to generate a minute vibration pulse of relatively high wave height when an ink of high viscosity is used, and to generate a minute vibration pulse of relatively low wave height when an ink of low viscosity is used. Since minute vibrations of a suitable level of intensity can be applied to an ink in accordance with its viscosity, a generation of an ink mist due to an excessive vibration can be prevented, and also an insufficient stirring of an ink due to too little vibration can be prevented.

Moreover, from the another point of view, when a wave height of a waveform element, which is intended to be used as a part of minute vibration pulse, is too high, a minute vibration pulse of a desired wave height can be generated by forming step-shaped parts having the same voltage level at the waveform element and a connection element following the waveform element, respectively, in accordance with this modification.

Next, the second modification of the aforementioned embodiment will be explained by referring to FIG. 6.

Figure 6:
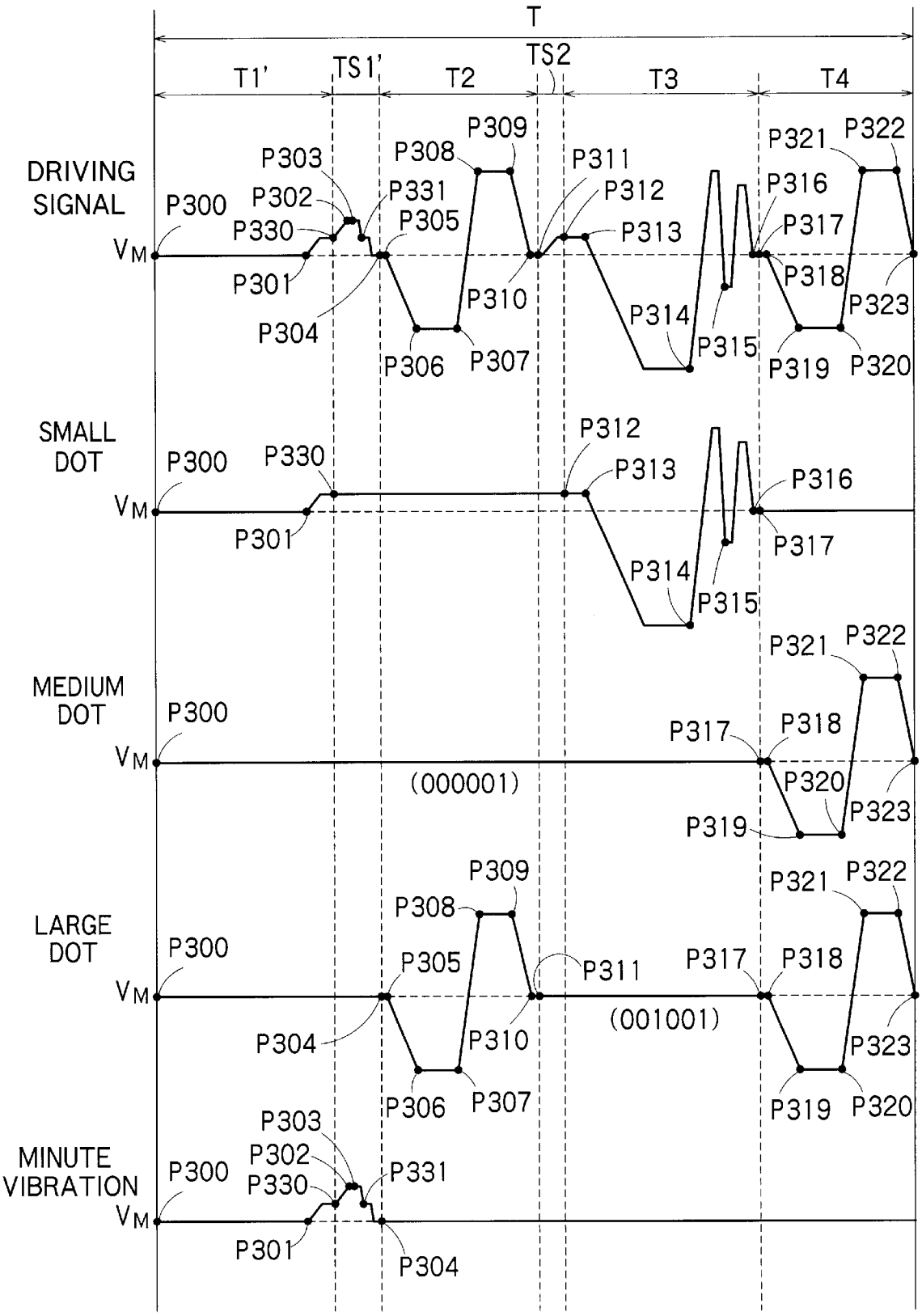
FIG. 6 is a drawing showing a driving signal, various driving pulses, and a minute vibration pulse of a second modification of the embodiment of the present invention.

FIG. 6 is a drawing showing a driving signal, various driving pulses, and a minute vibration pulse in this modification. Differences between the driving signal shown in FIG. 6 and the driving signal shown in FIG. 4 are that a step-shaped part (P330 included) is formed between P301 and P302, a step-shaped part (P331 included) is preferably formed between P303 and P304, and the height of the part of P312 to P313 included in the third waveform element (P312 to P317) of the period T3 is set slightly lower than that of the driving signal shown in FIG. 4, in correspondence to the height of P330 included in the step-shaped part.

As explained above, the step-shaped part including P330, the step-shaped part including P331 and the part P312 to P313 of the third waveform element are formed at the same voltage level.

Moreover, in this modification, the part of P330 to P303 of the driving signal constitutes not a waveform element, but a connection element. Namely, The part of P300 to P330 of the driving signal constitutes a first waveform element of a period T1', and the part P330 to P304 of the driving signal constitutes a first connection element of a period TS1'.

To generate a small dot driving pulse from the driving signal, the pulse generation means selects the whole of the first waveform element (P300 to P330) and the third waveform element (P312 to P317).

Further, when a minute vibration pulse is to be generated from the driving signal, the pulse generation means selects the first waveform element (P300 to P330) and the first connection element (P330 to P304).

Moreover, when an ink of low viscosity is used, the pulse generation means selects the whole of the first waveform element (P300 to P330) and the latter half (P331 to P304) of the first connection element (P330 to P304) to generate a minute vibration pulse of relatively low wave height.

As mentioned above, also in this modification, a minute vibration pulse can be generated by a combination of a waveform element and a connection element, so that the same effect as that of the aforementioned embodiment can be obtained.

In addition, according to this modification, since it is possible to generate a minute vibration pulse having a wave height that is higher than the height of the contraction waveform element (P301 to P330) constituting a preparatory part of a small dot driving pulse, a sufficient stirring effect for an ink can be obtained even for an ink of high viscosity. Moreover, since it is possible to generate a minute vibration pulse of relatively low wave height when an ink of low viscosity is used, a generation of an ink mist due to an excessive vibration can be prevented.

Figure 7:
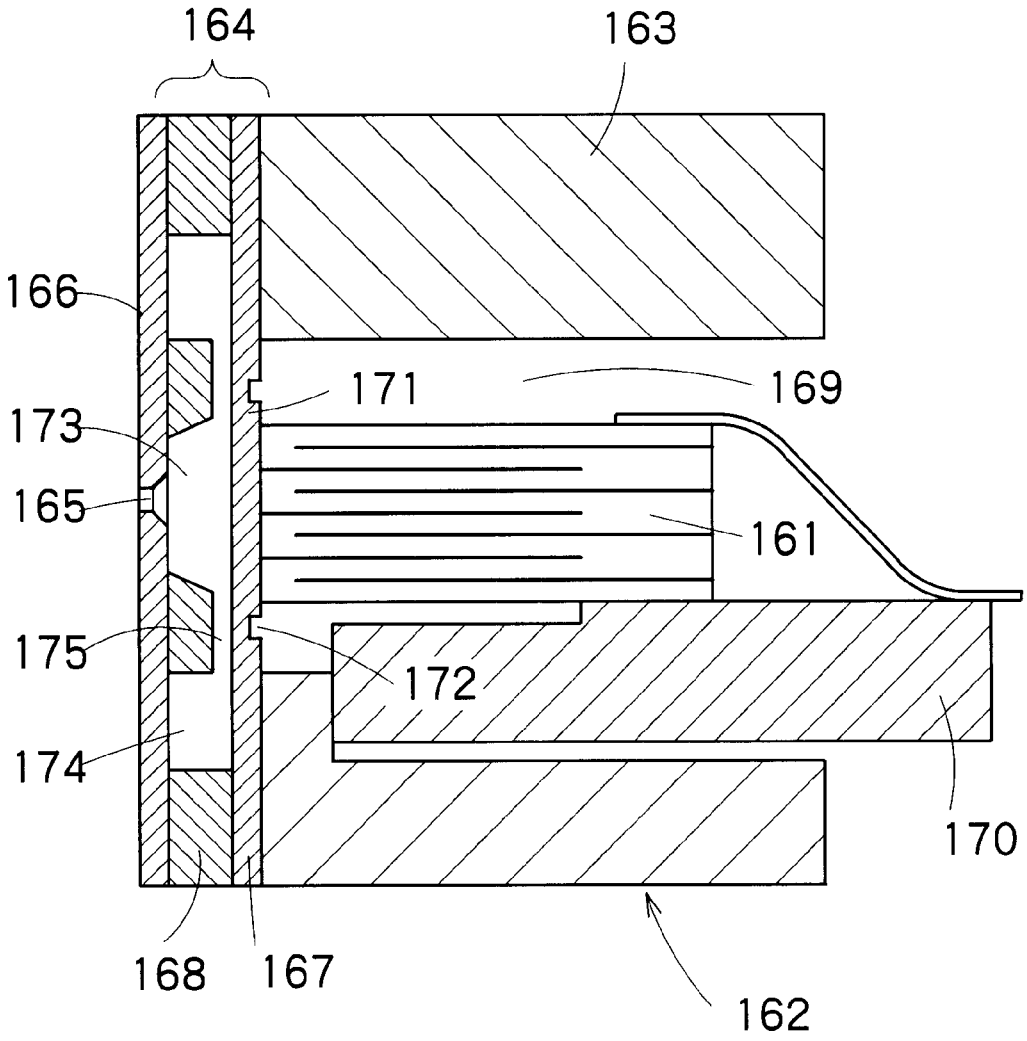
FIG. 7 is a sectional view showing the structure of another recording head applicable to the present invention.

In the aforementioned embodiment and the modifications thereof, the recording head 1 using the piezo-electric vibrators 25 of the deflection vibration mode as pressure generation elements is shown as an example. However, as shown in FIG. 7, the present invention can be also applied to a recording head 162 using piezo-electric vibrators 161 in the longitudinal vibration mode.

This recording head 162 has a synthetic-resin base pedestal 163 and a flow path unit 164 attached to the front (on the left of the drawing) of the base pedestal 163. The flow path unit 164 is composed of a nozzle plate 166 having a bored nozzle opening 165, a diaphragm 167, and a flow path forming plate 168.

The base pedestal 163 is a block-shaped member having a storage space 169 opened on the front and back. In the storage space 169, the piezo-electric vibrators 161 fixed to a fixing base plate 170 are stored.

The nozzle plate 166 is a thin laminar member having many bored nozzle openings 165 along the sub-scanning direction. The respective nozzle openings 165 are formed at a predetermined pitch corresponding to the dot forming density. The diaphragm 167 is a laminar member having an island part 171 as a thick part with which the piezo-electric vibrators 161 are in contact and an elastic thin part 172 formed so as to surround the island part 171.

Many island parts 171 are formed in a predetermined pitch so that one island part 171 corresponds to one nozzle opening 165.

The flow path forming plate 168 has an opening for forming a pressure chamber 173, a common ink chamber 174, and an ink feed path 175 for interconnecting the pressure chamber 173 and the common ink chamber 174.

The nozzle plate 166 is arranged on the front of the flow path forming plate 168, and the diaphragm 167 is arranged on the back side, and the nozzle plate 166 and the diaphragm 167 are integrated by adhesion in a state that the flow path forming plate 168 is held between them, and the flow path unit 164 is formed.

In the flow path unit 164, the pressure chambers are formed on the back side of the nozzle openings 165 and the island parts 171 of the diaphragm 167 are positioned on the back side of the pressure chambers 173. The pressure chambers 173 and the common ink chamber 174 are interconnected by the ink feed path 175.

The ends of the piezo-electric vibrators 161 are in contact with the back side of the island parts 171 and the piezo-electric vibrators 161 are fixed to the base pedestal 163 in the contact state. To the piezo-electric vibrators 161, a driving signal (COM) and print data (SI) are supplied via a flexible cable.

The piezo-electric vibrator 161 of the longitudinal vibration mode has a characteristic that when charged, it is contracted perpendicularly to the electric field, and when discharged, it is expanded perpendicularly to the electric field. Therefore, in the recording head 162, the piezo-electric vibrator 161 is contracted backward by charging, and the island part 171 is pulled backward in correspondence to the contraction, and the contracted pressure chamber 173 is expanded. In correspondence to this expansion, ink in the common ink chamber 174 flows into the pressure chamber 173 via the ink feed path 175. On the other hand, the piezo-electric vibrator 161 is expanded forward by discharging, and the island part 171 of the elastic plate is pressed forward, thus the pressure chamber 173 is contracted. In correspondence to this contraction, the ink pressure in the pressure chamber 173 increases.

As mentioned above, in the recording head 162, the relation between the voltage level and the expansion and contraction of the pressure chamber 173 due to charge and discharge of the piezo-electric vibrator 161 is inverse to that in each of the aforementioned embodiment and modifications. Therefore, when the recording head 162 is to be used, a driving signal and a driving waveform in which the driving signal and driving waveform indicated in the preceding embodiment are interchanged in positive and negative of voltage with respect to a boundary of the intermediate voltage. Namely, in the recording head 162, the pressure chamber 173 is filled with ink by increasing the voltage. In the same way, ink drops are ejected by decreasing the voltage. Even when the recording head 162 is used, the same operation effect as that of the aforementioned embodiment is obtained.

As mentioned above, according to the present invention, a minute vibration pulse is generated by a combination of a waveform element and a connection element, so that a plurality of driving pulses for generating a plurality of kinds of ink drops different in the ink volume and a minute vibration pulse for causing minute vibration to the meniscus can be set efficiently in a driving signal in one driving period free of reduction in the printing speed, that is, without extending the driving period.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A liquid jet apparatus comprising:

a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening;

driving signal generation unit to generate a driving signal to be used for generating a plurality of kinds of said driving pulses for ejecting said liquid drop and a minute vibration pulse to be applied to said pressure generation element so as to finely vibrate a meniscus of said liquid; and pulse generation unit to generate said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said pulse generation means generates said minute vibration pulse by a combination of at least a part of said waveform elements and at least a part of said connection element, and wherein said at least a part of said waveform elements is a preparatory waveform element which contracts said pressure chamber of a waiting condition without ejecting said liquid drop.

2. A liquid jet apparatus according to claim 1, wherein said driving pulses eject a plurality of kinds of said liquid drops different in volume, said driving pulse for ejecting said liquid drop of a smallest volume being generated by a combination of a plurality of said waveform elements, and wherein said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element.

3. A liquid jet apparatus according to claim 2, wherein a part of said waveform elements for ejecting said liquid drop of a smallest volume is formed in a step shape, wherein said connection element for connecting said part of a plurality of said waveform elements for ejecting said liquid drop of a smallest volume to another said waveform element is formed in a step shape, and wherein said minute vibration pulse is generated by a combination of a half of said waveform element of a step shape and a half of said connection element of a step shape.

4. A liquid jet apparatus according to claim 2, wherein said connection element follows said part of a plurality of said waveform elements for ejecting said liquid drop of a smallest volume, and wherein said connection element contracts said pressure chamber and then expands said pressure chamber.

5. A liquid jet apparatus according to claim 2, wherein a single pulse of said minute vibration pulse is generated in a single period of said driving signal.

6. A liquid jet apparatus according to claim 1, wherein said minute vibration pulse is generated from said at least a part of said waveform elements and said at least a part of said connection element following said at least a part of said waveform elements.

7. A liquid jet apparatus according to claim 1, wherein said plurality of waveform elements include ejection waveform elements for operating said pressure generation element so as to eject said liquid drops from said nozzle opening and charging waveform elements for operating said pressure generation element so as to charge said pressure chamber with said liquid, and wherein said pulse generation means generates said plurality of kinds of said driving pulses depending on timing for selecting said ejection waveform elements and said charging waveform elements.

8. A liquid jet apparatus according to claim 7, wherein said plurality of kinds of said driving pulses eject a plurality of kinds of said liquid drops different in volume, and wherein said plurality of waveform elements include a pair of said ejection waveform elements for ejecting said liquid drop of a largest volume and said ejection waveform element, disposed between said pair of said ejection waveform elements, for ejecting said liquid drop of a smallest volume.

9. A liquid jet apparatus according to claim 1, wherein said pressure generation element comprises a piezo-electric vibrator of a deflection vibration mode.

10. A liquid jet apparatus according to claim 1, wherein said pressure generation element comprises a piezo-electric vibrator of a longitudinal vibration mode.

11. A method for driving a liquid jet apparatus with a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening, comprising the steps of:

generating a driving signal to be used for generating a plurality of kinds of said driving pulses for ejecting said liquid drop and a minute vibration pulse to be applied to said pressure generation element so as to finely vibrate a meniscus of said liquid; and generating said minute vibration pulse and said driving pulses discretely by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said minute vibration pulse is generated by a combination of at least a part of said waveform elements and at least a part of said connection element, and wherein said at least a part of said waveform elements is a preparatory waveform element which contracts said pressure chamber of waiting condition without ejecting said liquid drop.

12. A method for driving a liquid jet apparatus according to claim 11, wherein said driving pulses eject a plurality of kinds of said liquid drops different in volume, said driving pulse for ejecting said liquid drop of a smallest volume being generated by a combination of a plurality of said waveform elements, and wherein said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element.

13. A method for driving a liquid jet apparatus according to claim 12, wherein a part of said waveform elements for ejecting said liquid drop of a smallest volume is formed in a step shape, wherein said connection element for connecting said part of a plurality of said waveform elements for ejecting said liquid drop of a smallest volume to another said waveform element is formed in a step shape, and wherein said minute vibration pulse is generated by a combination of a half of said waveform element of a step shape and a half of said connection element of a step shape.

14. A method for driving a liquid jet apparatus according to claim 13, wherein said connection element follows said part of a plurality of said waveform elements for ejecting said liquid drop of a smallest volume, and wherein said connection element contracts said pressure chamber and then expands said pressure chamber.

15. A method for driving a liquid jet apparatus according to claim 12, wherein a single pulse of said minute vibration pulse is generated in a single period of said driving signal.

16. A method for driving a liquid jet apparatus according to claim 11, wherein said minute vibration pulse is generated from said at least a part of said waveform elements and said at least a part of said connection element following said at least a part of said waveform elements.

17. A method for driving a liquid jet apparatus according to claim 11, wherein said plurality of waveform elements include ejection waveform elements for operating said pressure generation element so as to eject said liquid drops from said nozzle opening and charging waveform elements for operating said pressure generation element so as to charge said pressure chamber with said liquid, and wherein said pulse generation means generates said plurality of kinds of said driving pulses depending on timing for selecting said ejection waveform element and said charging waveform element.

18. A method for driving a liquid jet apparatus according claim 17, wherein said plurality of kinds of said driving pulses eject a plurality of kinds of said liquid drops different in volume, and wherein said plurality of waveform elements include a pair of said ejection waveform elements for ejecting said liquid drop in a largest volume and said ejection waveform element, disposed between said pair of said ejection waveform elements, for ejecting said liquid drop of a smallest volume.

19. A method for driving a liquid jet apparatus according to claim 11, wherein said pressure generation element comprises a piezo-electric vibrator of a deflection vibration mode.

20. A method for driving a liquid jet apparatus according to claim 11, wherein said pressure generation element comprises a piezo-electric vibrator of a longitudinal vibration mode.

21. A liquid jet apparatus comprising:

a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening;

driving signal generation unit to generate a driving signal to be used for generating a plurality of kinds of said driving pulses for ejecting said liquid drop and a minute vibration pulse to be applied to said pressure generation element so as to finely vibrate a meniscus of said liquid; and pulse generation unit to generate said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said pulse generation means generates said minute vibration pulse by a combination of at least a part of said waveform elements and at least a part of said connection element, wherein said driving pulses eject a plurality of kinds of said liquid drops different in volume, said driving pulse for ejecting said liquid drop of a smallest volume being generated by a combination of a plurality of said waveform elements, wherein said minute vibration pulse is generated by a combination of a part of a plurality of said waveform elements for ejecting said liquid drop of a smallest volume and at least a part of said connection clement for connecting said part of a plurality of said waveform elements for ejecting said liquid drop of a smallest volume to another said waveform clement, wherein a part of said waveform elements for ejecting said liquid of a smallest volume is formed in a step shape, wherein said connection element for connecting said part of a plurality of said waveform elements for ejecting said liquid drop of a smallest volume to another said waveform element is formed in a step shape, and wherein said minute vibration pulse is generated by a combination of a half of said waveform element of a step shape and a half of said connection element of a step shape.

22. A liquid jet apparatus comprising:

a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening;

driving signal generation unit to generate a driving signal to be used for generating a plurality of kinds of said driving pulses for ejecting said liquid drop and a minute vibration pulse to be applied to said pressure generation element so as to finely vibrate a meniscus of said liquid; and pulse generation unit to generate said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said pulse generation means generates said minute vibration pulse by a combination of at least a part of said waveform elements and at least a part of said connection element, wherein said driving pulses eject a plurality of kinds of said liquid drops different in volume, said driving pulse for ejecting said liquid drop of a smallest volume being generated by a combination of a plurality of said waveform elements, wherein said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element, and wherein a single pulse of said minute vibration pulse is generated in a single period of said driving signal.

23. A method for driving a liquid jet apparatus with a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening, comprising the steps of:

generating a driving signal to be used for generating a plurality of kinds of said driving pulses for ejecting said liquid drop and a minute vibration pulse to be applied to said pressure generation element so as to finely vibrate a meniscus of said liquid; and generating one of said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said minute vibration pulse is generated by a combination of at least a part of said waveform elements and at least a part of said connection element, wherein said driving pulses eject a plurality of kinds of said liquid drops different in volume, said driving pulse for ejecting said liquid drop of a smallest volume being generated by a combination of a plurality of said waveform elements, wherein said minute vibration pulse is generated by a combination of a part of a plurality of said waveform elements for ejecting said liquid drop of a smallest volume and at least a part of said connection element for connecting said part of a plurality of said waveform elements for ejecting said liquid drop of a smallest volume to another said waveform element, wherein a part of said waveform elements for ejecting said liquid drop of a smallest volume is formed in a step shape, wherein said connection element for connecting said part of a plurality of said waveform elements for ejecting said liquid drop of a smallest volume to another said waveform element is formed in a step shape, and wherein said minute vibration pulse is generated by a combination of a half of said waveform element of a step shape and a half of said connection element of a step shape.

24. A method for driving a liquid jet apparatus with a pressure generation element installed in correspondence to a pressure chamber interconnected to a nozzle opening, said pressure generation element adapted to be applied with a driving pulse thereby causing a pressure change to a liquid in said pressure chamber to eject a liquid drop from said nozzle opening, comprising the steps of:

generating a driving signal to be used for generating a plurality of kinds of said driving pulses for ejecting said liquid drop and a minute vibration pulse to be applied to said pressure generation element so as to finely vibrate a meniscus of said liquid; and generating one of said minute vibration pulse and said driving pulses by selecting a part of said driving signal, wherein said driving signal includes a plurality of waveform elements to be used to generate a plurality of kinds of said driving pulses and a connection element connecting said waveform elements between different voltage levels and not to be used to generate said driving pulses, wherein said minute vibration pulse is generated by a combination of at least a part of said waveform elements and at least a part of said connection element, wherein said driving pulses eject a plurality of kinds of said liquid drops different in volume, said driving pulse for ejecting said liquid drop of a smallest volume being generated by a combination of a plurality of said waveform elements, wherein said minute vibration pulse is generated by a combination of a part of a plurality of said waveform elements for ejecting said liquid drop of a smallest volume and at least a part of said connection clement for connecting said part of a plurality of said waveform elements for ejecting said liquid drop of a smallest volume to another said waveform element, and wherein a single pulse of said minute vibration pulse is generated in a single period of said driving signal.

* * * * *